US010244865B1

(12) United States Patent
Chauhan

(10) Patent No.: US 10,244,865 B1
(45) Date of Patent: Apr. 2, 2019

(54) HANGER SECURITY APPARATUS

(71) Applicant: Vijay Kanaiyalal Chauhan, Jersey City, NJ (US)

(72) Inventor: Vijay Kanaiyalal Chauhan, Jersey City, NJ (US)

(73) Assignee: Sushila D Chawla, Jersey City, NJ (US)

( * ) Notice: Subject to any disclaimer, the term of this patent is extended or adjusted under 35 U.S.C. 154(b) by 0 days.

(21) Appl. No.: 15/946,707

(22) Filed: Apr. 5, 2018

(51) Int. Cl.

| | |
|---|---|
| ***A47F 3/00*** | (2006.01) |
| ***A47F 5/08*** | (2006.01) |
| ***A47B 61/00*** | (2006.01) |
| ***A47G 25/14*** | (2006.01) |
| ***E05B 37/00*** | (2006.01) |
| ***E05B 51/00*** | (2006.01) |
| ***E05B 65/52*** | (2006.01) |
| ***E05B 69/00*** | (2006.01) |

(52) U.S. Cl.
CPC ..... *A47B 61/003* (2013.01); *A47F 3/002* (2013.01); *A47F 5/0861* (2013.01); *A47G 25/1464* (2013.01); *E05B 37/0072* (2013.01); *E05B 51/00* (2013.01); *E05B 65/52* (2013.01); *E05B 69/006* (2013.01)

(58) Field of Classification Search
CPC ..... E05B 37/0072; E05B 51/00; E05B 65/52; E05B 73/0094; E05B 73/00; E05B 73/0017; E05B 69/006; E05B 73/02; E05B 69/02; E05B 69/00; E05B 73/0005; E05B 73/0011; E05B 73/0023; E05B 73/0064; A47B 61/003; A47G 25/06; A47G 25/0692; A47G 29/10; A47G 29/124; A47G 25/1464; A47G 25/1471; A47G 25/145; A47G 25/1442; A47F 3/002; A47F 7/024; A47F 5/0891
USPC ..... 211/4, 7; 190/13 R, 24, 101; 312/107.5, 312/216; 220/210, 243, 248, 249, 475, 220/848; 70/58, 62, 77, 181; 206/298, 206/300
See application file for complete search history.

(56) References Cited

U.S. PATENT DOCUMENTS 438,735 A * 10/1890 Miller et al. ..... A63C 11/025 294/163
812,917 A * 2/1906 Bouhall ..... E05B 69/006 211/8

(Continued)

*Primary Examiner* — Jennifer E. Novosad
(74) *Attorney, Agent, or Firm* — Changi Wu; Changi Wu Law Office

(57) ABSTRACT

A hanger security apparatus for securing an access to a hook of a hanger on a rod, comprises a case; at least one bottom opening formed on the case; wherein the hook of the hanger can be moved in and out of the case through the at least one bottom opening; two side-openings formed on the case, wherein the rod is passed through the two side-openings; at least one door attached with the case, wherein the hook of the hanger can be accessed when the at least one door is in an open position, wherein the hook of the hanger is not accessible when the at least one door is in a closed position; at least one lock on the at least one door; a first stopper on the at least one door, wherein the first stopper is configured to be above the hook of the hanger to prevent an up movement of the hook when the at least one door is in the closed position; and a second stopper, wherein the third stopper is configured to limit the hanger from moving axially around the rod.

20 Claims, 5 Drawing Sheets

(56) References Cited

U.S. PATENT DOCUMENTS 1,695,517 A * 12/1928 Waldbauer ..... E05B 69/006 211/124
2,438,783 A * 3/1948 Kraft ..... A47B 61/00 211/4
2,460,997 A * 2/1949 Myers ..... A47G 25/06 211/115
2,758,902 A * 8/1956 O'Connor ..... A47B 61/00 312/265
2,953,251 A * 9/1960 Stone ..... A47J 47/16 211/4
3,438,506 A * 4/1969 Groth ..... A47F 5/01 211/4
3,543,941 A * 12/1970 Gorman ..... E05B 69/006 211/4
3,552,535 A * 1/1971 Strang ..... E05B 69/006 194/299
3,567,034 A * 3/1971 Mozelsio ..... A47G 25/0692 211/7
3,568,479 A * 3/1971 Fleck et al. ..... E05B 69/006 211/4
3,627,143 A * 12/1971 Alexander ..... A47F 7/24 211/123
3,647,072 A * 3/1972 Strang ..... G07F 17/10 211/4
3,659,721 A * 5/1972 Parillo ..... A47G 25/0692 211/7
3,661,268 A * 5/1972 Boley ..... A47G 25/1464 211/49.1
3,690,130 A * 9/1972 Eutzler ..... E05B 69/006 211/4
3,692,188 A * 9/1972 Bayne ..... A47F 7/24 211/49.1
3,735,875 A * 5/1973 Parillo ..... E05B 69/006 211/7
3,927,741 A * 12/1975 Rubinstein ..... A45C 13/18 190/101
3,939,985 A * 2/1976 Hochman ..... A47F 5/0823 248/220.22
3,985,183 A * 10/1976 Fernbaugh ..... E05B 69/006 211/7
3,987,898 A * 10/1976 Crane ..... B65D 5/725 206/300
4,036,366 A * 7/1977 Dixon ..... A22C 15/007 211/124
4,069,691 A * 1/1978 Simpson ..... E05B 69/006 211/4
4,069,919 A * 1/1978 Fernbaugh ..... E05B 69/006 211/4
4,155,458 A * 5/1979 Moline ..... B25H 3/04 211/4
4,189,044 A * 2/1980 Armstrong ..... G07F 11/40 194/343
4,204,601 A * 5/1980 Thomas ..... A47F 7/024 211/124
4,211,455 A * 7/1980 Tedrow ..... B25H 3/02 206/373
4,212,175 A * 7/1980 Zakow ..... E05B 73/0005 70/58
4,260,063 A * 4/1981 Bennett ..... E05B 69/006 211/4
4,293,076 A * 10/1981 Collin ..... B65D 85/185 206/289
4,336,885 A * 6/1982 Thomas ..... A47F 7/024 211/4
4,396,124 A * 8/1983 Feder ..... B65D 85/185 206/290
4,573,584 A * 3/1986 Otema ..... E05B 69/006 211/4
4,598,827 A * 7/1986 Keifer ..... E05B 69/006 211/4
4,753,355 A * 6/1988 Hall ..... A47G 25/145 211/105.1
4,823,569 A * 4/1989 Leinoff ..... E05B 69/006 211/4
4,854,656 A * 8/1989 O'Keefe ..... A45C 11/16 312/334.23
4,958,841 A * 9/1990 Keen ..... A47F 5/13 211/162
4,978,001 A * 12/1990 Nelson ..... A45C 11/16 206/6.1
5,016,758 A * 5/1991 Ward ..... A47F 7/24 211/4
5,018,627 A * 5/1991 Moore ..... A47F 7/24 206/291
5,076,446 A * 12/1991 Simmerman ..... A47F 5/0093 104/89
5,129,491 A * 7/1992 Seidman ..... A45C 13/03 190/13 R
5,154,072 A * 10/1992 Leyden ..... E05B 69/006 211/4
5,160,048 A * 11/1992 Leyden ..... A47F 7/24 211/7
5,359,786 A * 11/1994 Vierling ..... D06F 73/02 34/218
5,435,473 A * 7/1995 Larkum ..... B60R 9/08 211/4
5,520,291 A * 5/1996 Graham ..... A47B 81/005 211/4
5,588,631 A * 12/1996 Yee ..... B60R 11/06 211/4
5,697,508 A * 12/1997 Rifkin ..... A47G 25/0692 206/286
5,749,513 A * 5/1998 Strauser ..... B65D 5/003 206/280
5,785,184 A * 7/1998 Metselaar ..... E05B 69/006 211/168
5,823,358 A * 10/1998 Leyden ..... A47F 5/0861 211/8
6,223,915 B1 * 5/2001 Waner ..... A47F 7/19 211/124
6,230,904 B1 * 5/2001 Licari ..... A47F 7/0007 206/497
6,409,025 B1 * 6/2002 Moon ..... A47F 3/002 211/4
6,481,581 B2 * 11/2002 Sipe ..... A47B 81/00 211/4
6,568,545 B2 * 5/2003 Feder ..... A47F 7/24 206/291
6,736,300 B2 * 5/2004 Deakin ..... B60R 9/0485 224/315
6,863,185 B2 * 3/2005 Mele ..... A47F 7/024 211/14
6,883,670 B2 * 4/2005 Moon ..... A47F 3/002 211/175
6,948,628 B1 * 9/2005 Sahlem ..... A47G 25/0692 211/105.1
7,028,855 B2 * 4/2006 Edwards ..... A47G 25/145 211/123
7,219,464 B1 * 5/2007 Kujawa ..... A01K 97/08 211/70.8
7,628,281 B2 * 12/2009 Sopel ..... B60P 7/15 211/7
8,127,947 B2 * 3/2012 Chacon ..... B60R 9/00 211/123
8,387,808 B2 * 3/2013 Radowski ..... A47G 25/1464 211/123
8,800,785 B2 * 8/2014 Kalafut ..... A47F 5/0861 211/103
9,404,290 B2 * 8/2016 Leyden ..... E05B 73/0017
2014/0048670 A1 * 2/2014 Harris ..... F16M 11/00 248/346.03

* cited by examiner

HANGER SECURITY APPARATUS

BACKGROUND

Hangers are used to hang garments or other objects on a rod. If the rod is in a closet that has a locking mechanism, the access to the hangers is limited to the person with the key or password to open the lock of the closet. However, in an open area, such as a delivery area in an apartment for laundry concierge service's deliver of clean cloth, the deliver area will be accessible to people who can enter the apartment. Under such circumstances, there will need a person, such as doorman, to watch the clothes and allow only the garment owner to take his/her own garments. If there is no doorman on duty, the delivered garments will be at a stake of being stolen or mistaken.

BRIEF SUMMARY

This Brief Summary is included so as to introduce, in an abbreviated form, various topics to be elaborated upon below in the Detailed Description. This Brief Summary is not intended to identify key or essential aspects of the claimed invention. This Brief Summary is similarly not intended for use as an aid in determining the scope of the claims. The current invention overcomes the aforementioned issues of untended garments or other objects on a hanger and provides a hanger security apparatus that prevent unauthorized access to a hanger and remove a hanger from a rod.

DETAILED DESCRIPTION

Figure 1:
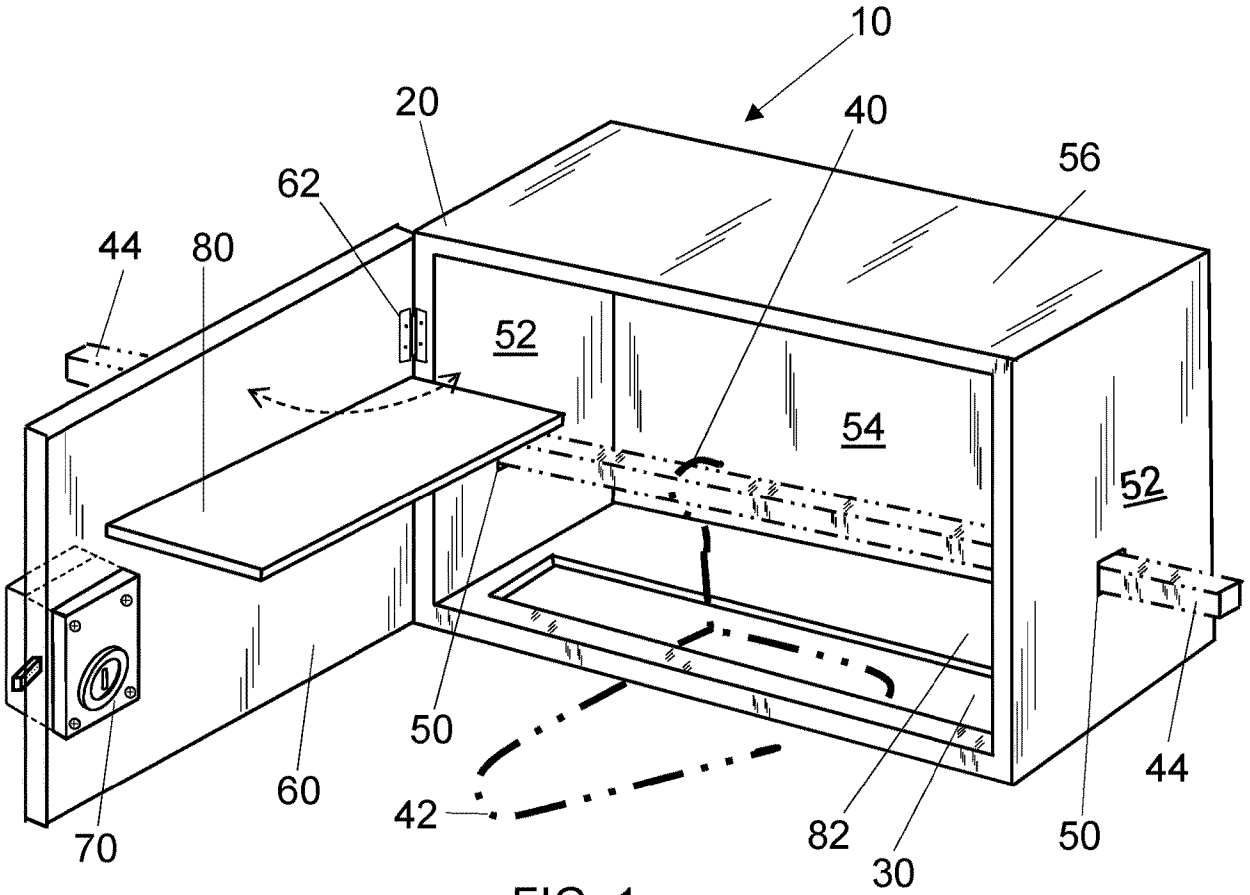
FIG. 1 is a perspective view of one of the embodiments of the present invention in an open position.

Referring now to FIG. 1, one embodiment of the hanger security apparatus 10 for securing an access to a hook 40 of a hanger 42 on a rod 44, comprising a case 20; at least one bottom opening 30 formed on the case 20; wherein the hook 40 of the hanger 42 can be moved in and out of the case 20 through the at least one bottom opening 30; two side-openings 50 formed on the case 20, wherein the rod 44 is passed through the two side-openings 50; at least one door 60 attached with the case 20, wherein the hook 40 of the hanger 42 can be accessed when the at least one door 60 is in an open position, wherein the hook 40 of the hanger 42 is not accessible when the at least one door 60 is in a closed position; and at least one lock 70 on the at least one door 60. Referring now to FIG. 1, in one of the embodiments, it may have a top panel 56, back panel 54, and two side panels 52. In one of the embodiments, the at least one door 60 can be attached to the case 20 by a hinge, joint or similar connection parts 62. Also referring to FIG. 1, in one embodiment, the at least one door 60 can be opened and swung in a left-right, or horizontal, direction in accordance with the hinge, joint or similar connection parts 62. Also referring to FIG. 1, in one embodiment, the hanger security apparatus 10 comprises a second stopper 82, wherein the second stopper 82 is configured to limit the hanger 42 from moving axially around the rod 44.

Figure 2:
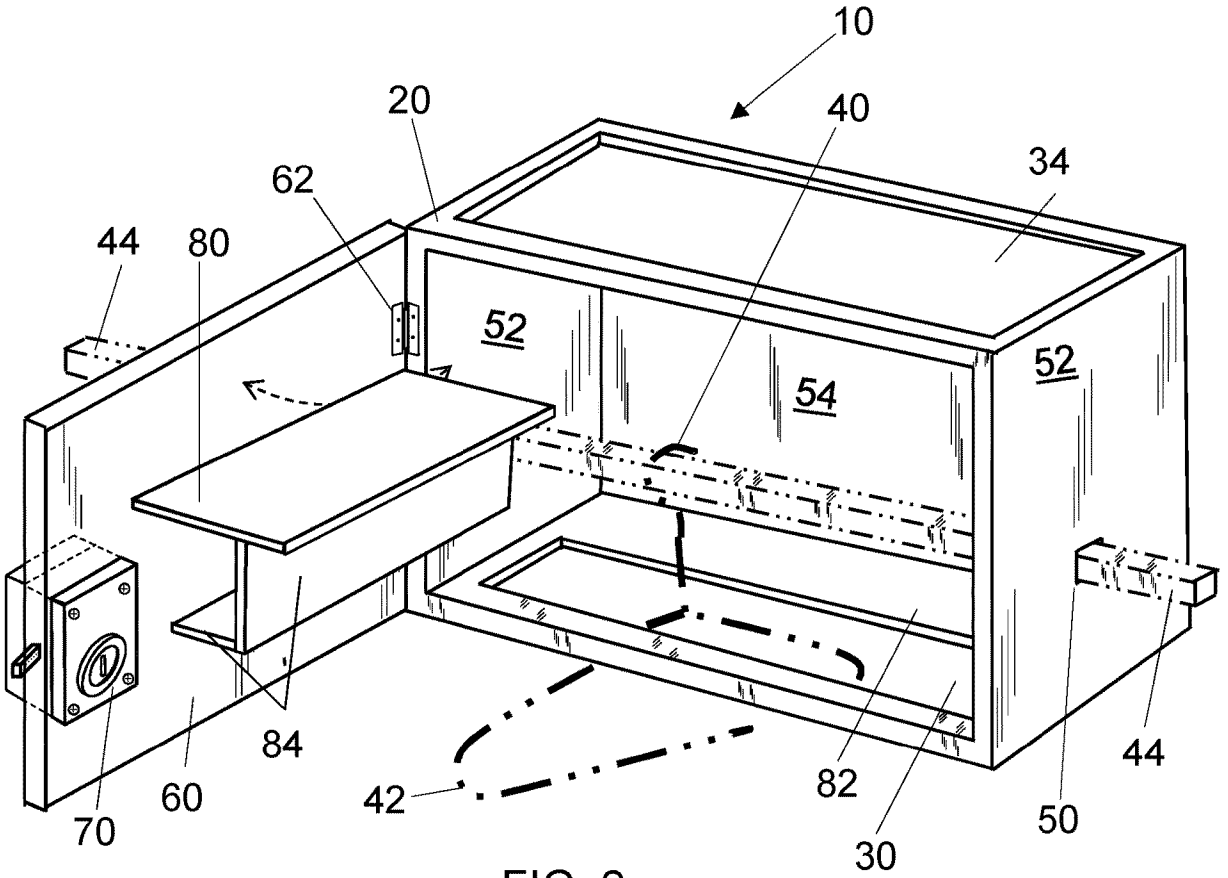
FIG. 2 is a perspective view of another embodiment of the present invention in an open position.

Now referring to FIG. 2, in one of the embodiments, the hanger security apparatus 10 may comprise a third stopper 84 on the at least one door 60, wherein the wherein the third stopper 84 is configured to limit the hanger 42 from moving axially around the rod when the at least one door 60 is in a closed position. Referring FIG. 2, in one embodiment, the third stopper 84 may be configured to have an extension toward the first stopper 80 to prevent rotating of the hanger 42 around the rod 44. The extension of the third stopper 84 is not limited to a straight shape or board shape, and any shapes that can prevent the rotating of the hanger 42 around can work, and is not necessary to touch the first stopper 80. Also referring to FIG. 1 and FIG. 3, the top panel 56 in one embodiment (FIG. 1) may be an open-top 34 in another one embodiment.

Figure 3:
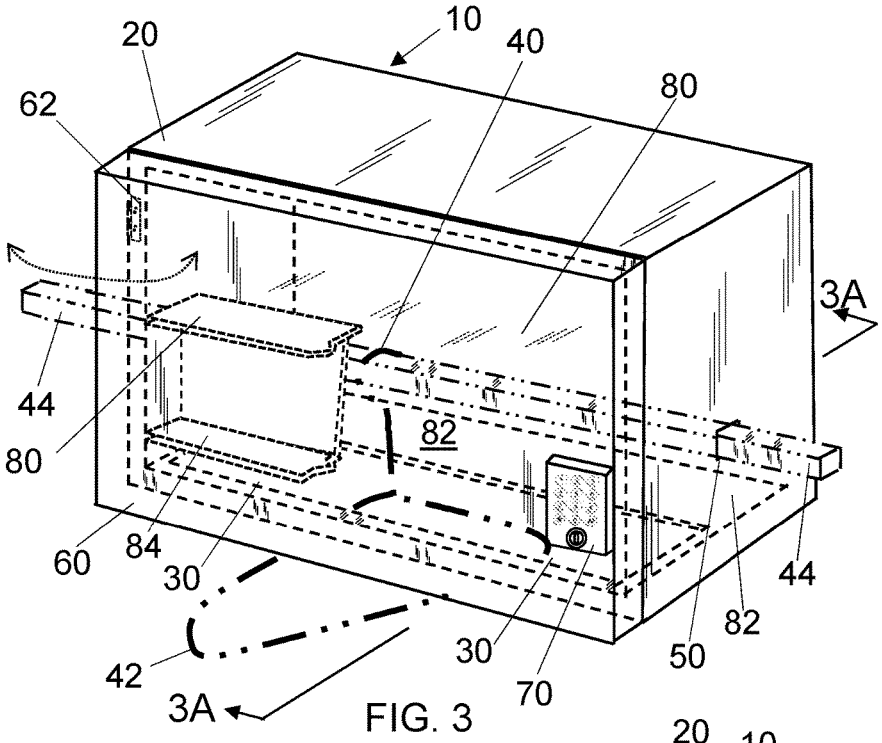
FIG. 3 is a perspective view of one of the embodiments of the present invention in a closed position and a partial view showing portion of parts inside the embodiment.
Figure 3A:
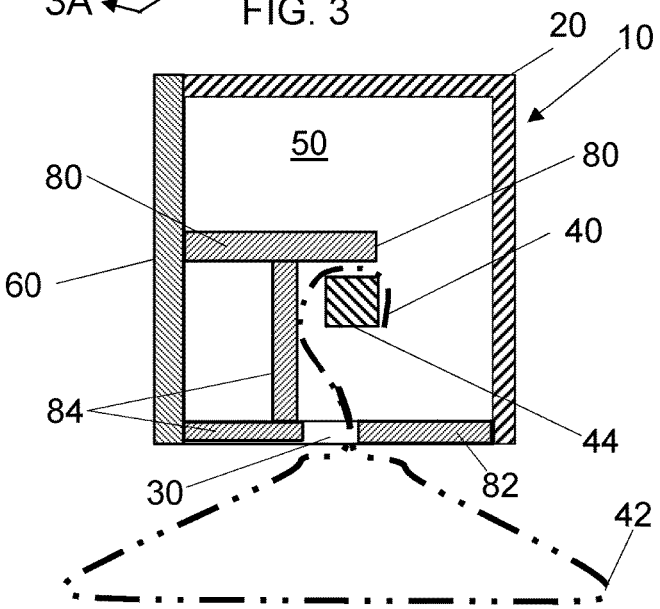
FIG. 3A is a sectional view of one of the embodiments of the present invention in a closed position shown in FIG. 3.

Referring now to FIGS. 2, 3, and 3A, in one of the embodiments, the hanger security apparatus 10 may further comprises a first stopper 80 on the at least one door 60, wherein the first stopper 80 is configured to be above the hook 40 of the hanger 42 to prevent the up movement of the hook 40 when the at least one door 60 is in the closed position, wherein the second stopper 82 is configured to limit the hanger 42 from moving axially, or rotating, around the rod 44, and wherein the third stopper 84 is configured to limit the hanger 42 from moving axially around the rod 44. Now referring to FIG. 2, when the at least one door 60 is in the open position, the first stopper 80 is moved together with the at least one door 60, the hook 40 with the hanger 42 then can be assessed to be removed from the hook 40. Also referring to FIG. 1 and FIG. 2, the lock 70 can be mechanically, electronically, and/or digitally operated, locked or unlocked, by key, password protected keypad, remote-control unit that is controlled by radio and/or wireless network, or a biometric recognition unit that is controlled by finger print recognition or iris recognition, and a combination thereof.

Figure 4:
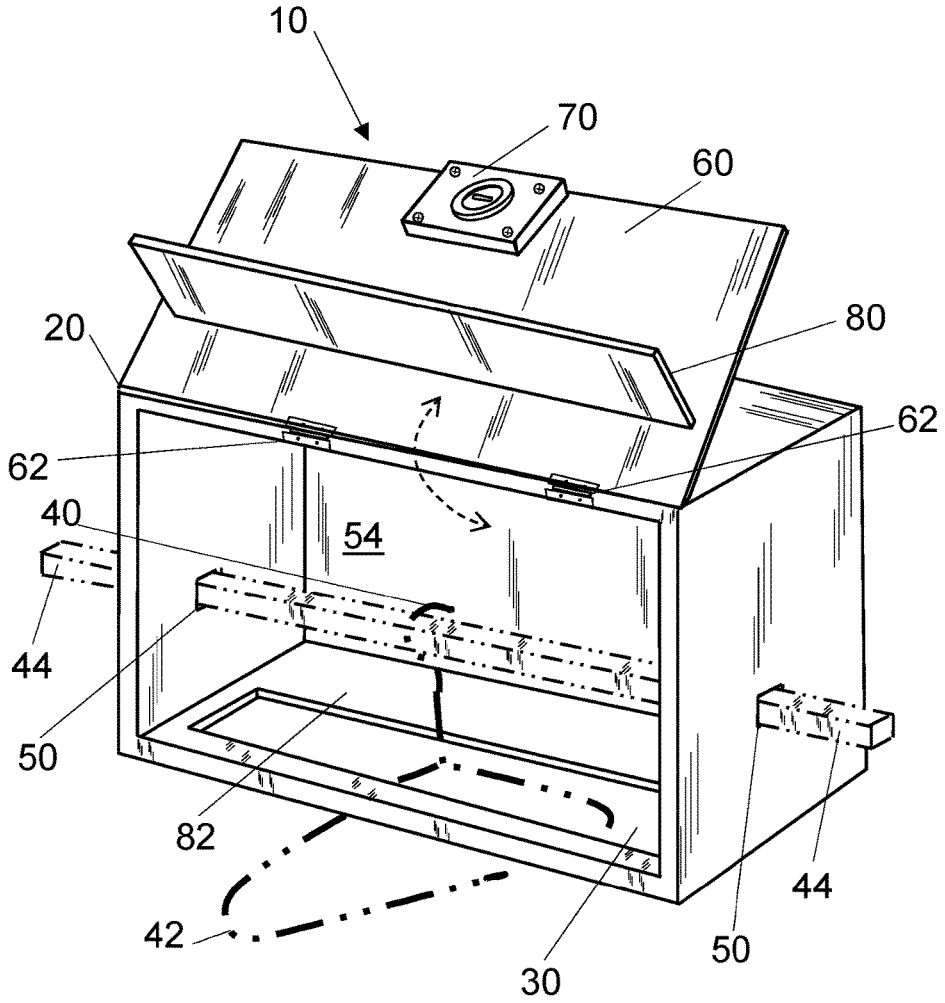
FIG. 4 is a perspective view of another embodiment of the present invention in an open position.

Now referring to FIG. 4, in another one embodiment, the hanger security apparatus 10 may have the at least one door 60 opened and swung in an up-down direction, or vertically, in accordance with the hinge, joint or similar connection parts 62.

Figure 5:
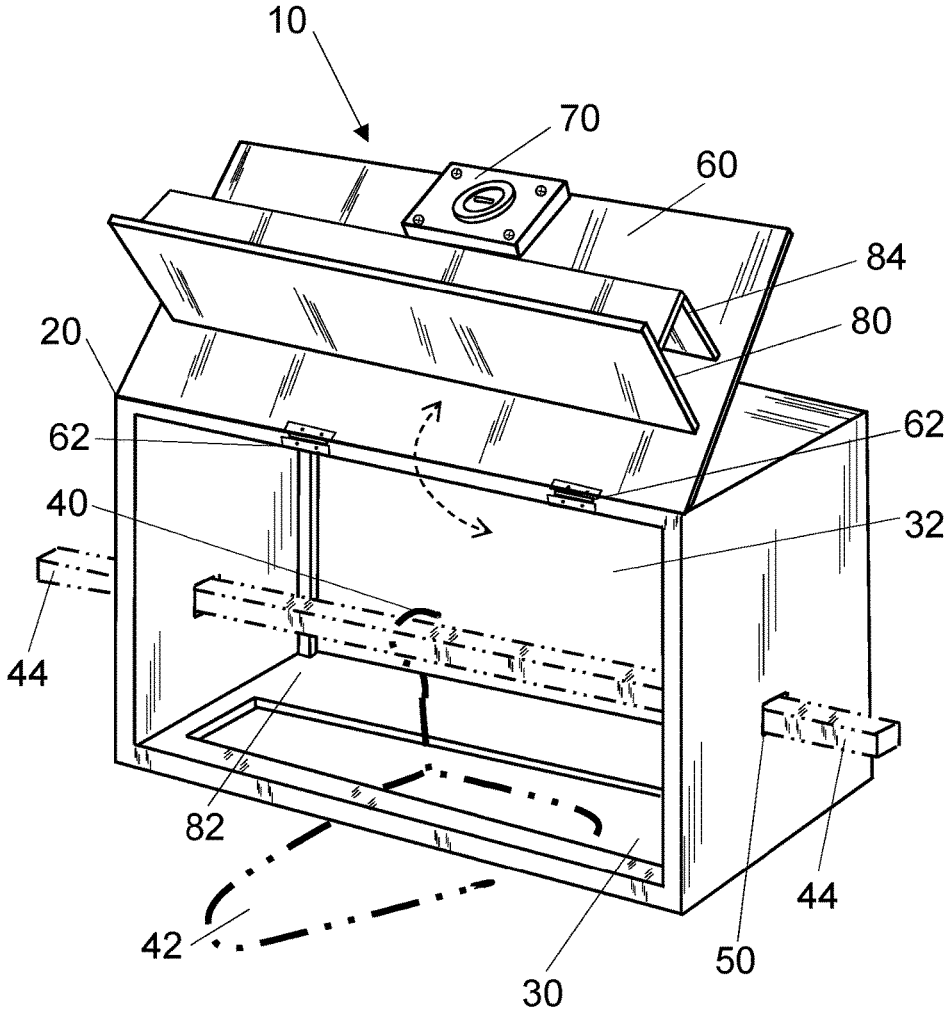
FIG. 5 is a perspective view of another embodiment of the present invention in an open position.

Now referring to FIG. 4 and FIG. 5, in another one embodiment, the back panel 54 in one embodiment (FIG. 4) may be an open-back 32 (FIG. 5).

In various embodiments, the hanger security apparatus 10 may be made in various materials, such as but not limited to metal, plastic, wooden, glass, stone, paper, or other material suitable for construction of cases, singular or hybrid. The shape of the case may be in any shape, not limited only to square or rectangle. The two side-openings 50 maybe in any shape suitable to the shape of the rod 44.

It is understood that the protective sleeve and its constituent parts described herein is an exemplary indication of a preferred embodiment of the invention, and is given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof.

What is claimed:

1. A hanger security apparatus for securing an access to a hook of a hanger on a rod attached to a supporting structure, comprising a case;

at least one bottom opening formed in the case; wherein the hook of the hanger can be moved in and out of the case through the at least one bottom opening;

two side-openings formed in the case, wherein the rod is adapted to be passed through the two side-openings;

at least one door attached with the case, wherein the hook of the hanger can be accessed when the at least one door is in an open position, wherein the hook of the hanger is adapted to not be accessible when the at least one door is in a closed position;

at least one lock on the at least one door;

a first stopper on the at least one door, wherein the first stopper is configured to be above the hook of the hanger to prevent an upward movement of the hook when the at least one door is in the closed position; and a second stopper, wherein the second stopper is configured to limit the hanger from moving axially around the rod.

2. The hanger security apparatus of claim 1, further comprising:

a third stopper on the at least one door, wherein the third stopper is configured to limit the hanger from moving axially around the rod when the at least one door is in the closed position.

3. The hanger security apparatus of claim 1, wherein the at least one lock further comprising a key to lock and unlock the lock.

4. The hanger security apparatus of claim 1, wherein the at least one lock further comprising a password protected keypad to lock and unlock the lock.

5. The hanger security apparatus of claim 1, wherein the at least one lock further comprising a remote-control unit to lock and unlock the at least one lock.

6. The hanger security apparatus of claim 1, wherein the at least one lock further comprising a biometric recognition unit to lock and unlock the at least one lock.

7. The hanger security apparatus of claim 1, wherein a top opening is formed in the case.

8. A hanger security apparatus for securing an access to a hook of a hanger on a rod attached to a supporting structure, comprising a case;

at least one bottom opening formed in the case; wherein the hook of the hanger can be moved in and out of the case through the at least one bottom opening;

two side-openings formed in the case, wherein the rod is adapted to be passed through the two side-openings;

at least one door attached with the case, wherein the at least one door is hinged vertically with the case;

at least one lock on the at least one door; and a first stopper on the at least one door, wherein the first stopper is configured to be above the hook of the hanger to prevent an upward movement of the hook when the at least one door is in a closed position.

9. The hanger security apparatus of claim 8, further comprising:

a second stopper, wherein the second stopper is configured to limit the hanger from moving axially around the rod; and a third stopper on the at least one door, wherein the third stopper is configured to prevent a movement of the hook when the at least one door is in the closed position.

10. The hanger security apparatus of claim 8, wherein the at least one lock further comprising a key to lock and unlock the lock.

11. The hanger security apparatus of claim 8, wherein the at least one lock further comprising a password protected keypad to lock and unlock the lock.

12. The hanger security apparatus of claim 8, wherein the at least one lock further comprising a remote-control unit to lock and unlock the at least one lock.

13. The hanger security apparatus of claim 8, wherein the at least one lock further comprising a biometric recognition unit to lock and unlock the at least one lock.

14. The hanger security apparatus of claim 8, wherein a top opening is formed in the case.

15. A hanger security apparatus for securing an access to a hook of a hanger on a rod attached to a supporting structure, comprising a case;

at least one bottom opening formed in the case; wherein the hook of the hanger can be moved in and out of the case through the at least one bottom opening;

two side-openings formed in the case, wherein the rod is adapted to be passed through the two side-openings;

at least one door attached with the case, wherein the at least one door is hinged horizontally with the case;

at least one lock on the at least one door;

a first stopper on the at least one door, wherein the first stopper is configured to be above the hook of the hanger to prevent an upward movement of the hook when the at least one door is in a closed position;

a second stopper, wherein the second stopper is configured to limit the hanger from moving axially around the rod; and a third stopper on the at least one door, wherein the third stopper is configured to prevent a rotation movement of the hook when the at least one door is in the closed position.

16. The hanger security apparatus of claim 15, wherein the third stopper comprises an extension toward the first stopper.

17. The hanger security apparatus of claim 15, wherein the at least one lock further comprising a key to lock and unlock the lock.

18. The hanger security apparatus of claim 15, wherein the at least one lock further comprising a password protected keypad to lock and unlock the lock.

19. The hanger security apparatus of claim 15, wherein the at least one lock further comprising a remote-control unit to lock and unlock the at least one lock.

20. The hanger security apparatus of claim 15, wherein the at least one lock further comprising a biometric recognition unit to lock and unlock the at least one lock.

* * * * *